United States Patent [19]

Katz

[11] Patent Number: 4,867,511

[45] Date of Patent: Sep. 19, 1989

[54] BATH CABINET AND HINGE THEREFOR

[75] Inventor: Howard S. Katz, Riegelsville, Pa.

[73] Assignee: Robern, Inc., Bensalem, Pa.

[21] Appl. No.: 194,454

[22] Filed: May 16, 1988

[51] Int. Cl.[4] ..... A47B 67/00

[52] U.S. Cl. ..... 312/227; 16/DIG. 43; 16/264; 16/386; 292/DIG. 37; 312/242

[58] Field of Search ..... 312/227, 319; 49/382, 49/394; 16/273, 382, DIG. 40, DIG. 43, 264, 386; 292/DIG. 37

[56] References Cited

U.S. PATENT DOCUMENTS

| | | | |
|---|---|---|---|
| Re. 17,510 | 12/1929 | Hoegger . | |
| 487,476 | 12/1892 | Faulhaber et al. | 16/264 |
| 651,464 | 6/1900 | Lint | 292/DIG. 37 |
| 1,152,728 | 9/1915 | Hathaway | 292/DIG. 37 |
| 1,718,026 | 6/1929 | Blackman | 312/227 |
| 1,802,552 | 4/1931 | Corcoran | 312/227 |
| 2,185,161 | 12/1939 | Tinnerman | 292/17 |
| 3,012,837 | 12/1961 | Morrissey | 312/319 |
| 3,758,141 | 9/1973 | Weinberger | 16/DIG. 40 |
| 4,133,142 | 1/1979 | Dzus | 292/DIG. 37 |
| 4,134,625 | 1/1979 | Palka | 312/206 |
| 4,412,708 | 11/1983 | Palka | 312/138 R |
| 4,604,769 | 8/1986 | Rock et al. | 16/382 X |
| 4,747,484 | 5/1988 | Ackeret | 312/319 X |

*Primary Examiner*—Joseph Falk

*Attorney, Agent, or Firm*—Robert C. Podwil

[57] ABSTRACT

A bath cabinet employs a fully concealed hinge and opening device, so that only the mirrored face of the door is seen on the front of the cabinet. The hinge bar is universal for left or right hand application and is affixed to the mirrored door. A cam arrangement, associated with the frame of the cabinet and a bumper mounted on the door, serves to selectively move the door out of the plane in which it rests when fully closed, to facilitate further opening of the door by grasping of an exposed edge.

16 Claims, 2 Drawing Sheets

BATH CABINET AND HINGE THEREFOR

BACKGROUND OF THE INVENTION

This invention relates to a bath cabinet, and in particular, to a bath cabinet in which the front face of the cabinet comprises an unframed mirrored door supported by concealed hinges, and means are provided to facilitate initial rotation of the door out of plane of its frame to facilitate initial opening. No conventional door pull is needed or used.

Numerous bath cabinet constructions have heretofore been proposed. For example, in U.S. Pat. No. 1,802,552, issued Apr. 28, 1931, to N. T. Corcoran, a cabinet was proposed which includes a spring-loaded door, held closed by a latch mechanism. Release of the latch allowed the bias of the spring to cause initial opening of the door.

In U.S. Pat. No. 4,134,625, issued Jan. 16, 1979, to J. J. Palka, a flush-mounted mirror-door was disclosed, but opening of the door was achieved by means of a door pull handle. Other cabinets of peripheral interest are disclosed in U.S. Pat. No. 1,718,026, issued June 18, 1929, to A. E. Blackman and Reissue Patent No. 17,510 issued December 3, 1929, to J. A. Hoegger.

BRIEF DESCRIPTION OF THE INVENTION

The present bath cabinet is one which employs fully concealed hinge bars, supporting a flush-mounted mirror-door, and an opening device, so that only the mirrored face of the door and small portions of its surrounding frame need be seen on the front of the cabinet. In accordance with the invention, the cabinet comprises the usual hollow body, adapted to be recessed within a wall, a frame structure associated with a body, and a mirrored door hingedly coupled to the frame and adapted to lie flush with the frame when in a closed position. The mirrored door comprises a planar panel, which needs no separate handle or pull, initial opening being facilitated by a cam arrangement which operates between the frame and the door.

The hidden hinge for the mirrored door comprises upper and lower hinge bars, preferably adhesively secured to the rear face of the door adjacent respective upper and lower edges of the door. Associated with the hinge bars, which are identical and "universal" for left or right hand application, are upper and lower hinge elements, pins of which engage bushed openings in the frame. A cam surfaced bumper element is affixed to the lower hinge bar, and is fashioned to cooperate with a reciprocable pin associated with the frame to displace the door to an ajar position. In the ajar position, an edge of the door edge exposed and readily grasped for further opening.

Accordingly, it is a principal object of this invention to provide a cabinet structure (and a hinge assembly for such a structure) which is mechanically simple yet durable, economical, aesthetically attractive and easy to manufacture and use.

There is seen in the drawings a form of the invention which is presently preferred (and which represents the best mode contemplated for carrying the invention into effect), but it should be understood that the invention is not limited to the precise arrangements and instrumentalities shown or described.

DESCRIPTION OF PREFERRED EMBODIMENT

Figure 1:
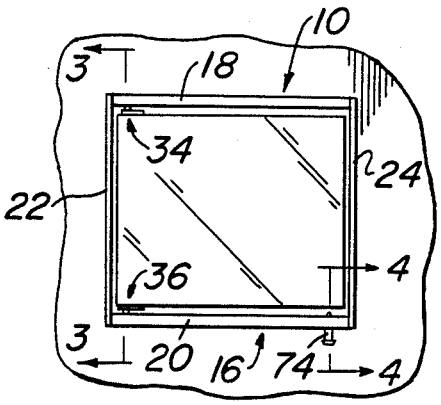
FIG. 1 is a front elevation view, showing a bath cabinet in accordance with the present invention.

Referring now to the drawings in detail, wherein like reference numerals indicate like elements, there is seen in FIG. 1 a bath cabinet designated generally by the reference numeral 10. The cabinet 10 comprises a hollow body member 12 (best seen in FIG. 3), which typically includes a closed rear wall (not shown) and an open front wall, designated generally by the reference numeral 14. A frame, designated generally by the reference numeral 16, is associated with the body member 12, and includes at least upper 18 and lower 20 horizontal members. Vertical frame members 22 and 24 join the upper 18 and lower 20 horizontal members. As is seen in the drawings, the upper 18 and lower 20 horizontal members may consist of extruded or cast shapes, of conventional or "custom" configuration.

A door, in the form of a planar mirror 26, is hingedly connected to the frame 16 in juxtaposition to the open wall 14 or the body member 12. The mirror door 26, as is perhaps best seen in FIGS. 3 and 4, may be of laminated construction, including an outer layer or pane 28, an inner pane 30, and a polymeric bonding layer 32 between the panes 28 and 30. The mirror door 26 is itself unframed and self-supporting, and its edges may be suitably beveled or otherwise finished for safety and aesthetic effect.

Figure 3:
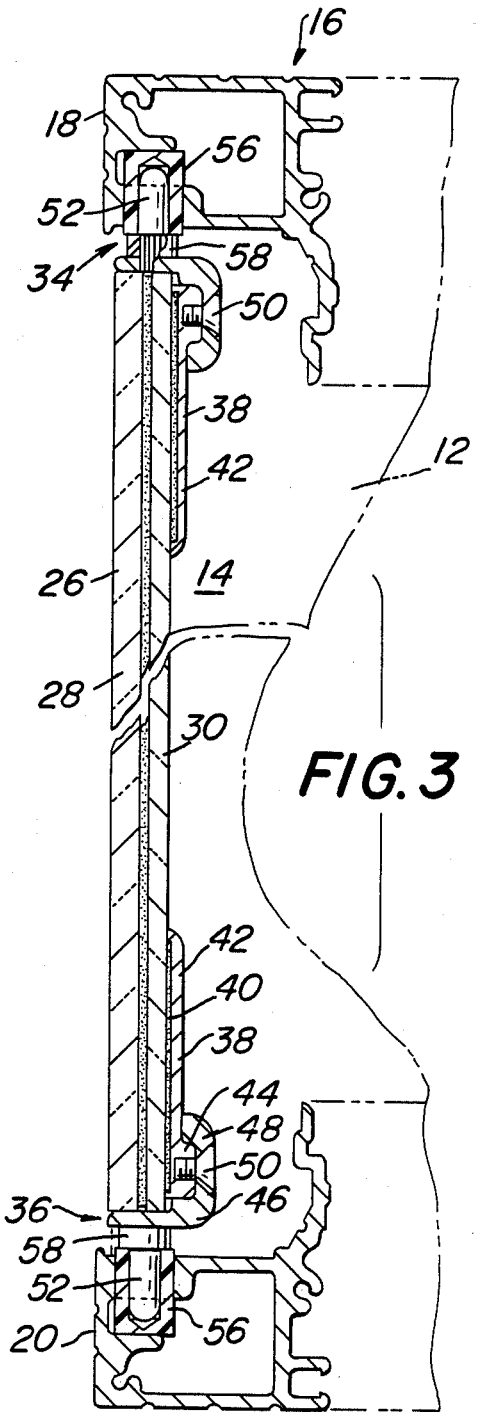
FIG. 3 is a cross-sectional view, in elevation, taken along the line 3—3, in FIG. 1.
Figure 2:
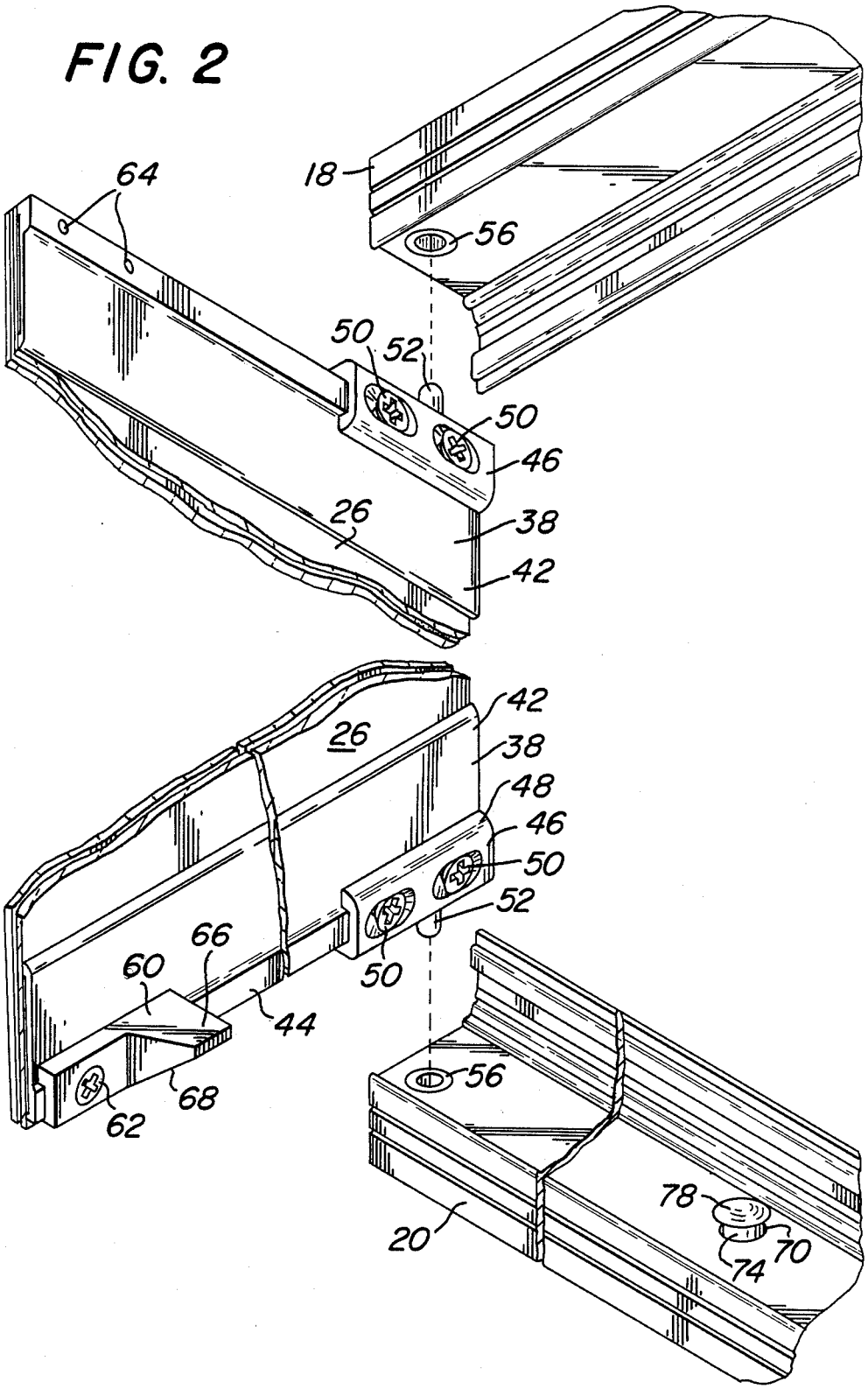
FIG. 2 is an exploded view illustrating top and bottom hinges for the door of the bath cabinet in accordance with the invention.

The mirror door 26 is coupled to the frame 16 by a totally concealed hinge arrangement, comprising in the illustrated embodiment upper and lower hinge assemblies designated generally by the reference numerals 34 and 36. Referring to FIG. 2 and 3, the hinge assemblies 34 and 36 will now be described in detail.

Each hinge assembly 34 and 36 comprises a hinge bar 38, affixed to the rear surface of the mirror door 26, in the illustrated embodiment to the rear surface of the inner panel 30. As is apparent, the hinge bars 38 are disposed adjacent respective upper and lower edges of the door 26. A simple and effective technique for affixing the hinge bars 38 to the mirror door 26 is the use of a double-faced pressure-sensitive tape 40, seen in FIG. 3. Other means, such as durable epoxy or other adhesives may occur to those skilled in the art and may also serve.

The preferred cross-sectional configuration of the hinge bars 38 is best seen in FIGS. 2 and 3, and includes a relatively thin flange portion 42 and an enlarged or raised ridge portion 44. The ridge portion 44 is disposed closest to the edge of the mirror door 26 when the hinge bar 38 is applied to the mirror door 26. The flange portion 42 may be recessed, as shown, to receive the tape 40.

Associated with the hinge bars 38 are hinge elements 46, preferably identical, which include flange portions 48, complemental in contour to the cross-sectional profile of portions of the hinge bars 38, including the ridge portions 44. As is perhaps best seen in FIG. 3 and is also apparent from FIG. 2, the hinge bars 38 may be drilled and tapped to receive screws 50 to secure the flange portions 48 of the hinge elements 46 to the hinge bars 38. The hinge elements 46 also include hinge pins 52, secured to the flange portions 48 of the hinge elements 46. When the hinge elements are operatively disposed, the hinge pins 52 are coaxial and extend in opposite directions perpendicularly with respect to the hinge bars 38.

Referring now to FIGS. 2 and 3, it will be seen that the hinge pins 52, are rotatably coupled to the upper 18 and lower 20 frame members. For this purpose, the frame members 18 and 20 may be provided with drilled openings 54, into which are fitted bushings 56, preferably of plastic polymeric material having suitable structural and frictional characteristics. A slight degree of friction between the hinge pins and bushings 56 is considered ideal, inasmuch as it facilitates relatively easy rotation of the mirror door 26 for opening while allowing the mirror door to hold a desired position. The bushings 56 may be press fitted into the openings 54. The hinge pins 52 may have enlarged portions 58 adjacent to the bushings 56 to facilitate positioning of the hinge elements 46 and mirror door 26 relative to the bushings 56.

Figure 4:
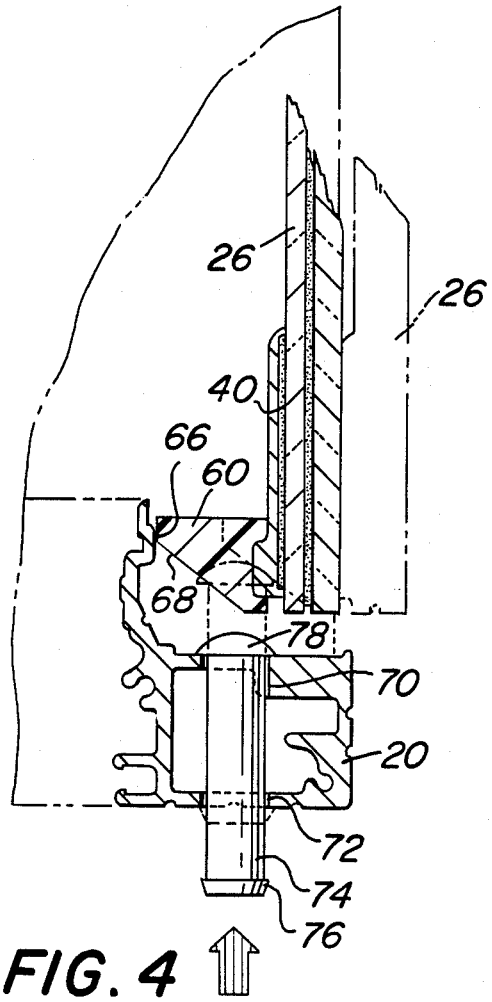
FIG. 4 is a partial cross-sectional view, taken along the line 4—4 in FIG. 1 and showing in particular the cam arrangement for initially rotating the door out of the plane in which it lies when fully closed.

Referring to FIGS. 1 and 4, a mechanism for selectively displacing the mirror door 26 from its closed position will now be described.

Affixed to the lower hinge bar 38 is a bumper element 60, preferably made of structural plastic, such as nylon, polyethylene, or other suitably hard and durable structural plastic. The bumper element 60 may be affixed to the hinge bar 38 by means of a screw 62, associated with a hole 64, one of a number similar holes 64 drilled and tapped in the ridge portions 44 of the hinge bars 38. As is best seen in FIG. 4, when the mirror door 26 is in its fully closed position, a projecting limit stop 66 of the bumper element 60 abuts a surface of the lower horizontal member 20. The bumper element 60 also includes a downwardly facing obliquely disposed cam surface 68, the function of which will now be described.

Mounted within aligned openings 70 and 72 in the lower horizontal member 20 is a reciprocable pin 74, retained in the openings 70, 72 by an enlarged lower and 76 and an enlarged mushroom-like domed upper end 78. To initiate opening of the mirror door, manual pressure may be applied to the pin 74 in the direction of the arrow in FIG. 4, thus causing the pin 74 to translate upwardly with respect to the lower horizontal member 20. Early in its travel, however, the domed upper end 78 of the pin 74 engages the cam surface 68 of the bumper element 60, thus causing the mirror door to rotate about the hinge pins 52 to approximately the dotted line position in FIG. 4. With the mirror door thus displaced, the edge of the mirror door 26 may be grasped by hand and manipulated to the open position.

A significant aspect of the present apparatus is illustrated in FIG. 2. Referring now to that Figure, it should be apparent with reference to the hinge bars 38 that one configuration of the hinge bar 38 may be used "universally" for left or right hand application or as the upper or lower hinge bar. This is made possible by providing the hinge bar 38 with pairs of spaced predrilled and tapped holes near its respective ends, to receive the screw 62 and the screws 50 which secure the hinge elements 46. The holes 64 described above in connection with the bumper element 60, one of which receives the screw 62, are one such pair. By providing each hinge bar 38 with spaced pairs of holes at each of its ends, a hinge element 46 or, as the case may be, bumper element 60, may be mounted at either end of the hinge bar and the hinge bar may serve in an upper and lower location, for left or right hand application. Although the illustrated bumper element 60 is not one, a "universally" designed bumper element is also within the purview of the invention.

The present invention may be embodied in other specific forms without departing from its spirit or essential attributes. Accordingly, reference should be made to the appended claims rather than the foregoing specification as indicating the scope of the invention.

I claim:

1. In a bath cabinet comprising a hollow body having an open front wall, a frame associated with said body having respective upper and lower horizontal members, and a mirror door hingedly coupled to said frame and adapted to lie flush with the frame when in a closed position, said mirror door comprising a planar panel having an outwardly facing front face and a rear face juxtaposed to the front wall of the body, hinge apparatus for said mirror door comprising: an upper hinge bar affixed to rear face of said mirror door adjacent to one bar affixed to the rear face of said mirror door adjacent to a second edge thereof and extending along said second edge, said hinge bars being affixed to said mirror door and hidden from view when said mirror door is in a closed position, and hinge members affixed to said respective hinge bars and operatively coupled to the respective upper and lower horizontal members of said frame, said hinge bars and said hinge elements being substantially identically configured and interchangeable, and means operatively interconnecting said frame and said mirror door for selectively displacing said mirror door to an ajar position from its closed position flush with the frame to facilitate opening of said mirror door.

2. Apparatus in accordance with claim 1, and said hinge bars being affixed to said mirror door by pressure-sensitive adhesive tape.

3. Apparatus in accordance with claim 1, wherein said means for selectively displacing said mirror door comprises a cam member affixed to one of said hinge bars and a manually actuable member coupled to one of said horizontal frame members, said manually actuable member being adapted to engage said cam member to cause said mirror door to pivot to the ajar position.

4. Apparatus in accordance with claim 3, wherein said cam member includes a limit stop for positioning said mirror door in its closed position.

5. Apparatus in accordance with claim 3, wherein said cam member and said hinge elements are affixed to said hinge bars by screws.

6. Apparatus in accordance with claim 1, wherein said hinge elements comprise flange portions complemental in profile to at least a portion of said hinge bars, and hinge pins adapted to engage said frame members.

7. Apparatus in accordance with claim 6, wherein said hinge elements comprise hinge pins rotatably coupled to said frame members.

8. Apparatus in accordance with claim 7, and friction bushings in said frame members adapted to receive and frictionally engage said hinge pins.

9. Apparatus in accordance with claim 8, and means operatively interconnecting said frame and said mirror door for selectively displacing said mirror door to an ajar position from its closed position flush with the frame to facilitate opening of said door.

10. Apparatus in accordance with claim 9, wherein said means for selectively displacing said mirror door comprises a cam member affixed to one of said hinge bars and a manually actuable member coupled to one of said horizontal frame members, said manually actuable member adapted to engage said cam member to cause said mirror door to pivot to the ajar position.

11. Apparatus in accordance with claim 10, wherein said cam member includes a limit stop for positioning said mirror door in its closed position.

12. Apparatus in accordance with claim 10, wherein said cam member and said hinge elements are affixed to said hinge bars by screws.

13. A bath cabinet comprising a hollow body member having an open front wall, a mirror door coupled to said body member, and concealed hinges hingedly interconnecting said body member and mirror door to permit said mirror door to selectively close said front wall, said hinges comprising upper and lower hinge bars affixed to the rear face of said mirror door and hidden from view when said mirror door is in a closed position, said hinge bars adjacent and extending across respective upper and lower edges of said mirror door, hinge members affixed to said hinge bars and pivotably coupled to said body member, and means operatively interconnecting said body member and said mirror door for selectively displacing said mirror door to an ajar position from its closed position.

14. Apparatus in accordance with claim 13, and a limit stop affixed to one of said hinge bars so as to position said mirror door with respect to said body member when said mirror door is in its closed position.

15. Apparatus in accordance with claim 13, and a limit stop affixed to one of said hinge bars so as to position said mirror door with respect to said body member when said mirror door is in its closed position, said means for selectively displacing said mirror door comprising a cam element associated with said limit stop and a manually actuable member coupled to said body member, said manually actuable member being adapted to engage said cam member to cause said mirror door to pivot to its ajar position.

16. A bath cabinet having a frame and a planar mirror door hingedly coupled to the frame and adapted to lie flush with the frame when in a closed position, and hinge apparatus for said mirror door comprising upper and lower hinge bars affixed to the rear face of said mirror door adjacent to and extending across respective upper and lower edges of said mirror door, said hinge bars being hidden from view when said mirror door is in a closed position, said hinge bars being substantially identically configured and interchangeable one for the other, and hinge members affixed to said respective hinge bars and operatively coupled to the frame, said hinge bars having a cross-section comprising a flange portion and a ridge portion of a thickness greater than the thickness of said flange portion, said ridge portions being oriented, when said hinge bars are operatively disposed, in the direction of said upper and lower edges, and said hinge members comprising flange portions complemental in cross-section to the cross-sectional profile of said hinge bars, means on said hinge bars to facilitate coupling said hinge members to said hinge bars at selected ends thereof, and a bumper member affixed to one of said hinge bars and having a limit stop therein for positioning said mirror door with respect to said body member when said mirror door is in its closed position, said bumper member having a cross-sectional profile of said hinge bars, said bumper member being affixed to said one hinge bar at an end of said hinge bar spaced from the hinge member affixed to said hinge bar.

* * * * *

UNITED STATES PATENT AND TRADEMARK OFFICE

CERTIFICATE OF CORRECTION

PATENT NO. : 4,867,511

DATED : September 19, 1989

INVENTOR(S) : Howard S. Katz

It is certified that error appears in the above-identified patent and that said Letters Patent is hereby corrected as shown below:

In column 4, line 26, after the word "one" insert -- edge thereof and extending along said one edge, a lower hinge --.

In column 6, line 34, after the word "a", insert -- cross-section complemental in cross-section to the --.

Signed and Sealed this

Twenty-first Day of August, 1990

*Attest:*

HARRY F. MANBECK, JR.

*Attesting Officer*

*Commissioner of Patents and Trademarks*